United States Patent [19]

Bever

[11] 4,299,545

[45] Nov. 10, 1981

[54] HYDRAULIC OIL WELL PUMPING APPARATUS

[76] Inventor: Hilton Bever, 119 E. Fifth St., Williamstown, W. Va. 26187

[21] Appl. No.: 61,685

[22] Filed: Jul. 30, 1979

Related U.S. Application Data

[63] Continuation of Ser. No. 807,685, Jun. 17, 1977, abandoned.

[51] Int. Cl.[3] ..... F04B 47/04

[52] U.S. Cl. ..... 417/490; 417/401; 91/314; 91/347; 92/146

[58] Field of Search ..... 417/390, 398, 399, 401; 60/372; 91/347, 314; 92/146

[56] References Cited

U.S. PATENT DOCUMENTS

| | | | |
|---|---|---|---|
| 1,053,032 | 2/1913 | Harris | 91/347 X |
| 1,523,031 | 1/1925 | Mitchell, Jr. | 417/333 |
| 2,019,353 | 10/1935 | Lower | 417/390 X |
| 2,072,595 | 3/1937 | Hutchinson | 60/372 |
| 2,276,016 | 3/1942 | Brantly | 92/146 X |
| 2,462,571 | 2/1949 | Thompson et al. | 91/347 X |
| 2,728,193 | 12/1955 | Bacchi | 60/372 |
| 2,836,122 | 5/1958 | Johnson | 417/390 |
| 2,898,866 | 8/1959 | Deackoff | 417/390 X |
| 2,925,806 | 2/1960 | Taylor | 91/347 X |
| 2,942,552 | 6/1960 | Wayt | 417/390 X |
| 3,632,234 | 1/1972 | Lake | 417/399 X |
| 3,782,117 | 1/1974 | James | 60/372 |
| 4,099,447 | 7/1978 | Ogles | 60/372 X |
| 4,114,375 | 9/1978 | Sarvwatari | 60/372 |
| 4,167,098 | 9/1979 | James | 60/372 X |

*Primary Examiner*—Leonard E. Smith

*Attorney, Agent, or Firm*—John T. Roberts; Donald E. Stout

[57] ABSTRACT

An oil well pump which uses a pair of vertical hydraulic pistons to raise a cross beam. The polish rod is secured to the cross beam. At the top of the stroke automatic limit switches reverse the hydraulic fluid flow to allow the polish rod to descend and complete the pumping cycle.

2 Claims, 11 Drawing Figures

HYDRAULIC OIL WELL PUMPING APPARATUS

CROSS-REFERENCE TO RELATED APPLICATION

This invention is a continuation in part of my application for a patent entitled Hydraulic Oil Well Pumping Apparatus, filed June 17, 1977, Ser. No. 807,685, now abandoned.

FIELD OF INVENTION

The principal application of this invention is oil well pumps although it is equally applicable to deep water wells.

The common oil well pump is a subsurface pump at the bottom of the well. This pump will be at the bottom of a tubing which carries the liquid to the surface. The tubing will in turn be inside a metal casing.

The subsurface pump has two one way valves, a lower stationary valve and a upper traveling valve. As the traveling valve is raised, the stationary valve opens admitting oil in to the chamber. At the top of the stroke the stationary valve closes and the traveling valve opens as its begins its downward stroke. The liquid passes above the traveling valve and is lifted up on the next upward movement of the traveling valve.

DESCRIPTION OF PRIOR ART

The prior art consists broadly of two types, mechanical and hydraulic, indicating how to transform the rotary power of the engine to the required reciprocal power for the polish rod.

The standard mechanical pump, called a horse head, employs a pivoted beam, with the end attached to the polish rod. Since the lift is not vertical, cables are employed, which after extended use will break.

Various types of hydraulic pumps disclosed in the prior art. One type employs a single cylinder which surrounds or is mounted above the polish rod. U.S. Pat. No. 2,168,711 discloses a single hydraulic cylinder above the polish rod which pulls the polish rod into the cylinder on the upstroke. The U.S. Pat. No. 2,608,517 discloses a single hydraulic cylinder with the polish rod extending through it in a tube with a sleeve, surrounding the tube, connecting the polish rod and the piston.

U.S. Pat. No. 3,632,234 discloses four hydraulic cylinders, two powered by a pump and two slave cylinders connected to an accumulator. U.S. Pat. No. 2,019,353 discloses two cylinders operating an unsupported cross beam, to which the polish rod is connected.

SUMMARY OF THE INVENTION

The pump of this invention allows a substantially lighter pump, weighing as little as one-third to one-fourth as much as current pumping units of the same capacity.

The pump of this invention is completely self-contained, requiring only a single attachment of polish rod to cross beam to begin pumping. The set up time is substantially less than current pumping units of the same capacity.

The pump of this invention is mounted on skids, which allow easy and rapid movement from well to well. This feature becomes more important as the many older low production wells are reopened for intermittent operation.

The pump of this invention is built entirely of standard widely available parts. The elimination of all specially built parts makes replacement or repair much quicker, thus lessening down time.

The pump of this invention allows a longer stroke and therefore a greater pumping efficiency than either the hydraulic or mechanical prior art pumps.

The pump of this invention allows for more rapid attachment than the prior art hydraulic single cylinder pump. The polish rod need not be strung through the surrounding cylinder of the hydraulic piston such as shown in the above-recited patents.

The pump of this invention allows greater and easier adjustment of the length of the sucker rod string. Heretofore the polish rod had to be field cut to accomodate either the single surrounding hydraulic piston or to fit beneath a single overhead cylinder. As pumping occurs friction and wear increase the length of the sucker rod string. With this invention, adjustment is easy and rapid. The polish rod may extend any reasonable distance above the cross beam.

STRUCTURE OF THE DISCLOSED EMBODIMENT

The principal elements of the pump of this invention are a pair of hollow skids, 36, a pair of vertical supports, 15, a pair of hydraulic cylinders, 7, and engine, 70, hydraulic pump, 81, and main valve, 45.

Figure 1:
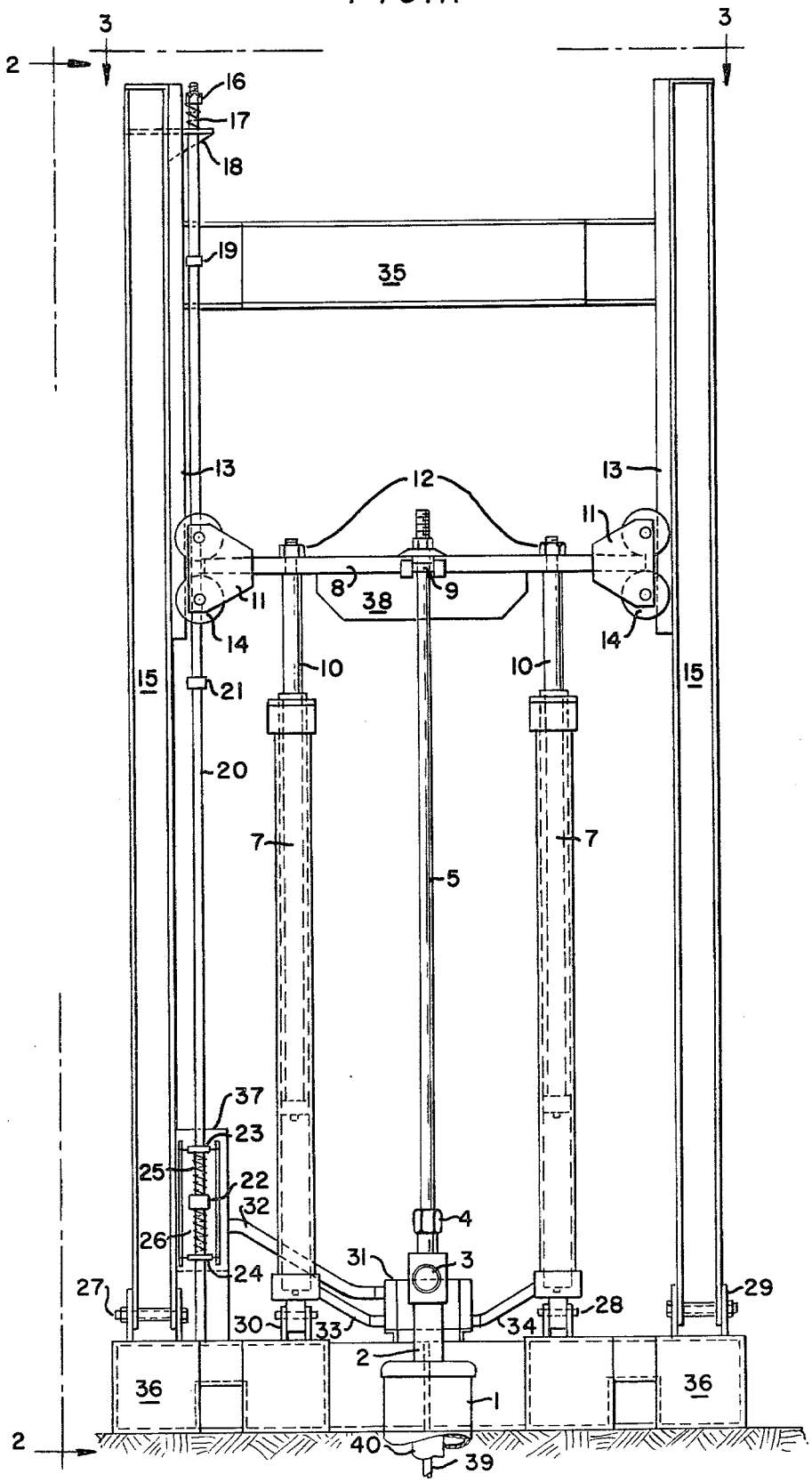
FIG. 1 is a front elevation view of the pump operating mechanism constructed in accordance with my invention, illustrating the manner in which the mechanism may be mounted over the well.

As shown in FIG. 1 the pump of this invention is placed above a well having a well casing head, 1, surrounding a tubing, 2, inside of which is the sucker rod string, 39. The polish rod, 5 extends out of the stuffing block, 4, which is immediately above the flow line tee, 3. The oil is pumped up through pipes 40 and 2, and out the flow line tee, 3, to the discharge point.

The polish rod, 5, is attached to the carrier or cross beam, 8, by rod clamps, 6, and polish rod retainer notch, 9. As can be seen, the polish rod may be attached to the carrier beam at any point over its length and may be rapidly adjusted during the pumping operation as needed.

The pump of this invention is mounted on four hollow skids collectively denoted as, 36. These skids also function as a reservoir for the hydraulic fluid as will be explained. Mounted on the skids are a pair of upright support posts, 15. These are mounted on a pair of post pivot plates, 29, by pivot pins, 27, and are held in position by removable brace, 57, which is attached to the rear of skid, 36, by post, 58. The braces, 57, are attached to the vertical support by pins, 58*a*, and are attached to the posts 58 by pins 58*b*.

A pair of hydraulic pistons, 7, are also pivotedly mounted on the skids. The lower end of the pistons are attached to piston pivot supports, 30 by piston pivot pins, 28. The two piston rods, 10, are attached at their upper end to carrier beam, 8. The outer end of the carrier beam has a pair of plates, 11, to which are attached beam guides wheels, 14.

Figure 3:
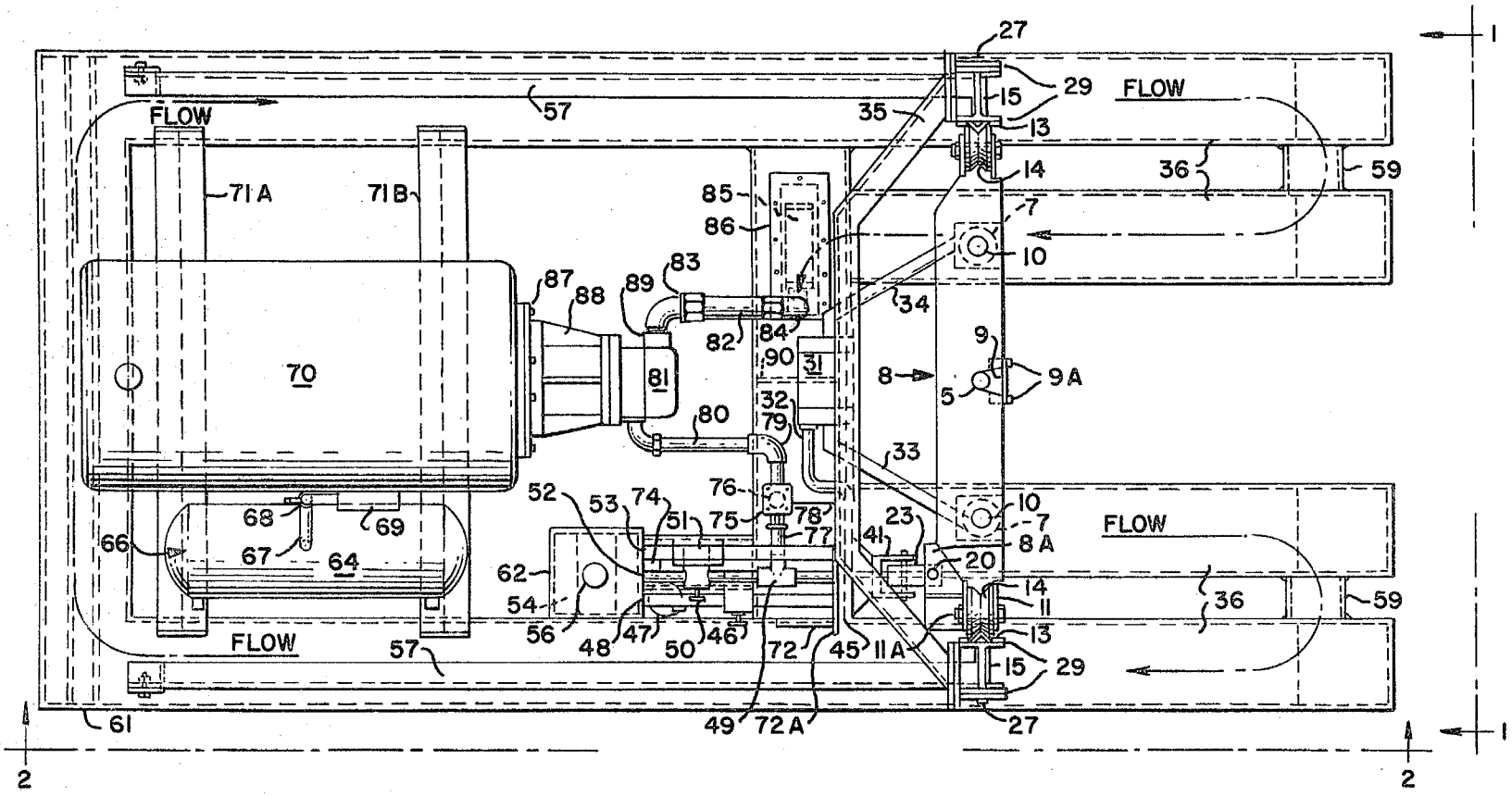
FIG. 3 is a horizontal sectional view taken on lines 3—3 of FIG. 2.
Figure 4:
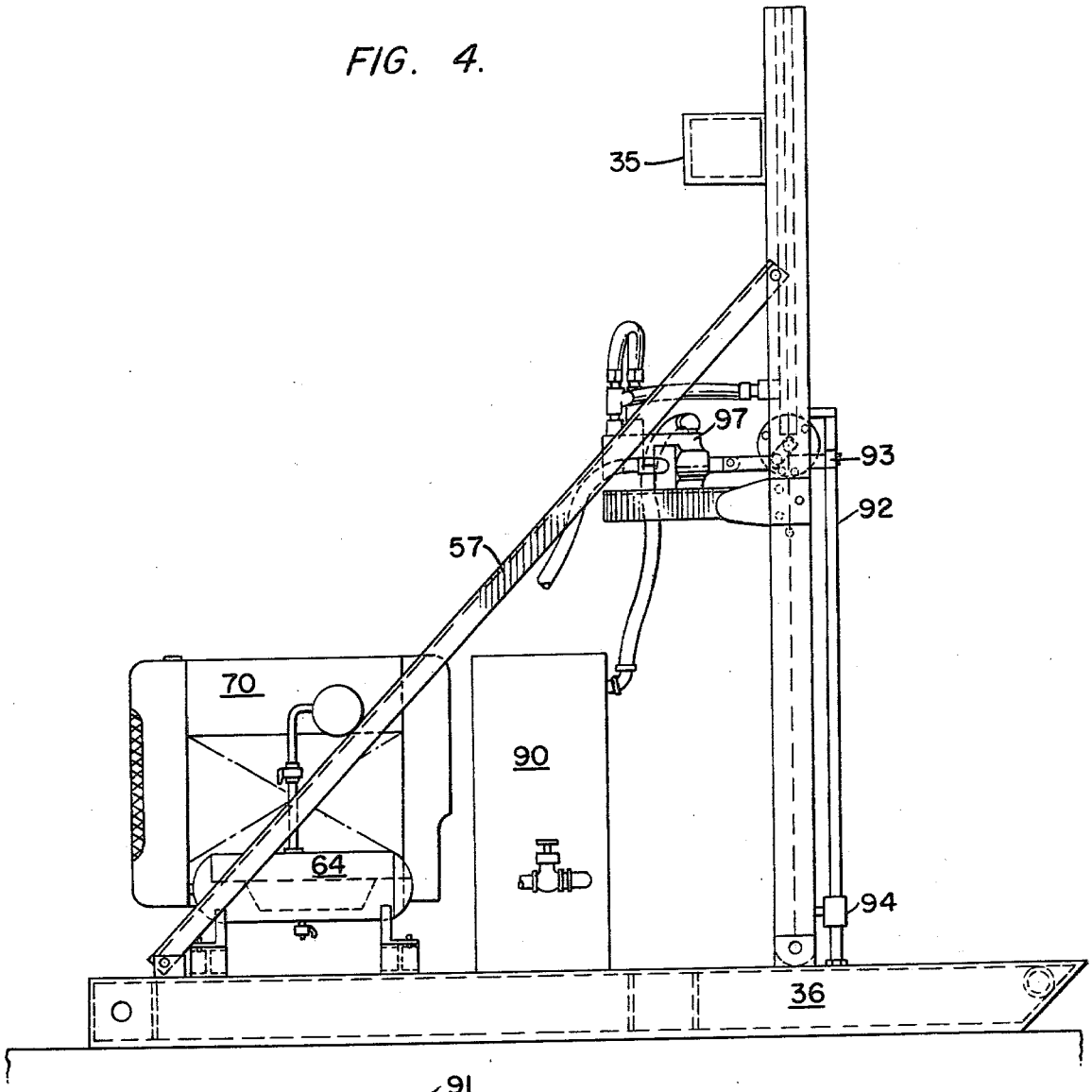
FIG. 4 is a side elevation view of a modified version of the invention.

The wheels, 14, ride on tracks, 13, extending along the interior sides of the upper portion of the two uprights, 15. The two supports, 15, are held, near their upper end by top upright brace, 35, which is bent, as shown in FIG. 3 to allow the free travel of carrier beam, 8.

During movement of the pump the braces, 57, are removed and the upright support posts, 15, hydraulic cylinders, 7, and associated apparatus may be swung downwardly allowing easier travel.

Associated with carrier beam, 8, is trip acuator plate, 8*a*, extending out and surrounding trip rod, 20. Trip rod, 20, is held at its upper end by top bracket, 18, through which it passes, spring, 17, and fastener, 16, and is held at its lower end by a similar plate, 37, and spring, 17*a*, and fastener, 16*a*. The trip rod has a lower set collar, 21, and upper trip rod set collar, 19. In addition, it has a centering set collar, 22, and top trip mechanisms spring, 25, and lower trip mechanisms spring, 26, coacting with top trip lever, 23, and lower trip lever, 24.

The position of carrier beam, 8, and therefore the polish rod, 5, is dictated by the amount of hydraulic fluid in the two hydraulic cylinders, 7. Hydraulic fluid flows into these two cylinders in equal amounts through lines, 33 and 34, from flow divided, 31, which insures the equal distribution of the fluid.

As carrier beam, 8, rises, the trip actuator plate, 8*a*, will contact upper trip rod collar, 19, raising the trip rod, 20, and the centering set collar, 22, until top trip lever, 23, is operated. In a sequence of operations to be explained hereinafter, the hydraulic fluid flow is now reversed, with the fluid flowing through lines 33 and 34, and through flow divided, 31, back into the reservoir. The carrier beam, 8, is lowered until the trip actuator plate, 8*a*, contacts the lower set collar, 21, causing the centering set collar, 22, to trip the lower trip lever, 24. This reverses the operation allowing the hydraulic fluid to go from the pump, 81, through pipe, 32, flow divided, 31, lines, 33 and 34, thus again raising the carrier beam, 8, and polish rod, 5.

The engine, 70, is of a standard commercial design and may contain a multi-fuel regulator, 69, permitting it to be run from gas retrieved from the well. This gas may be introduced at inlet, 66, to storage tank, 64, which serves as an accumulator and moisture separator. The moisture may be drained by valve, 65. The gas is transferred to the engine, 70, through lines, 67, to regulator, 69, where it is mixed in the carburetor. A shut off valve, 68, is shown on the engine as running on fuel only.

The engine may be mounted on cross braces, 63, extending across the skids, 36. The engine may be held on the cross braces, 63, by fasteners, 71*a* and 71*b*, as shown.

Attached to the engine, 70, is a hydraulic adapter, 87, pump adapter housing, 88, on which is mounted the hydraulic pump, 81.

The flow of hydraulic fluid in the reservoir-skids, 36, is, as shown in FIG. 3, forward in the lower short skid from the chamber, 70, through front cross over pipe, 59, to the lowest skid where it flows to the rear, across the rear portion, surrounding aperture, 61, forward on the upper long skid, through cross over pipe, 59, and returning in the upper short skid to the suction strainer, 85. The fluid flows through strainer, 86, and into inlet line, 84, hose, 82, pipe fittings, 83 and 89, and into hydraulic pump, 81. The fluid flows out through flexible hose, 80, which serves as an isolator line, through fitting, 79, to relief valve, 75. This valve maintains the system pressure, and is of a direct acting type with a pilot held exposed to system fluid pressure on one side and opposed by the spring of preset force of the other. Should the system pressure exceed this setting of the valve spring, the fluid unseats the pilot, allowing a controlled amount of fluid to bypass through a port located in the bottom of its housing to reservoir, 36.

Figure 2:
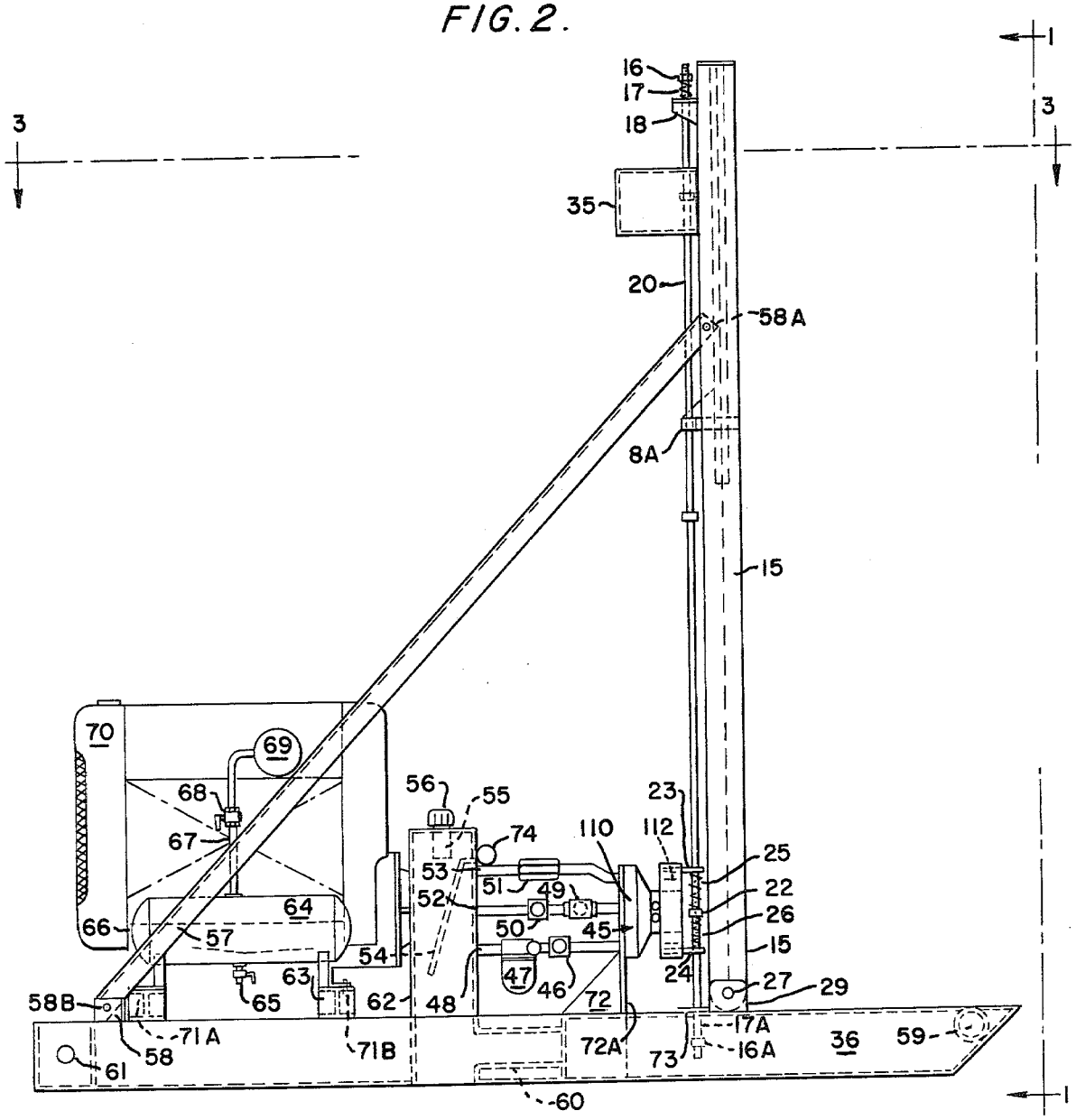
FIG. 2 is a side view of the pump operating mechanism constructed in accordance with my invention, taken on lines 2—2 of FIG. 1.

The fluid passing by relief valve, 75, goes to tee, 49. As shown in FIGS. 2 and 3, one side of the tee goes through upstroke speed control valve, 50, to port, 52, into sump, 62, of the reservoir. Adjustment of valve, 50, acts as a throttle governing the amount of fluid which will pass the other way in the tee, 49, into directional valve, 45.

During the upward movement of hydraulic pistons, 7, the fluid from pump, 81, goes through valve, 45, into line, 32, and then into the pistons, 7, as described above. During the withdrawal of the fluid from the pistons, the fluid from pump, 81, goes into valve, 45, and returns in line, 53, to the sump, 62. A check valve, 51, in line, 53, maintains the required back pressure in that line.

When the carrier beam, 8, is lowered by withdrawing fluid from the pistons, 7, the fluid returns through flow divider, 31, and line, 32, to valve, 45. It there is directed into line, 48, which empties into sump, 62. In line, 48, is a throttle valve, 46, which may be adjusted to control the speed of the lowering of carrier beam, 8. A standard return filter, 47, to trap any foreign particles may also be included in return line, 48.

The directional valve, 45, is actually two valves, a main valve 110 which controls the hydraulic fluid from the pump to the cylinders and to the sump as explained above and a second control valve 112. The control valve 112 is powered from hydraulic line, 78, and is operated by trip levers, 23 and 24, as explained above. When the bottom trip lever, 24, has been depressed the control valve 112 causes the main valve 110 to connect line, 80, from the pump to line, 32, to the flow divided and further seals off lines, 53 and 48. When trip lever, 23, is moved, this causes the control valve 112 to connect line, 80, through tee, 49, to return line, 53, and to further connect line, 32, from the cylinder, 7, to the return line, 48.

Figure 11:
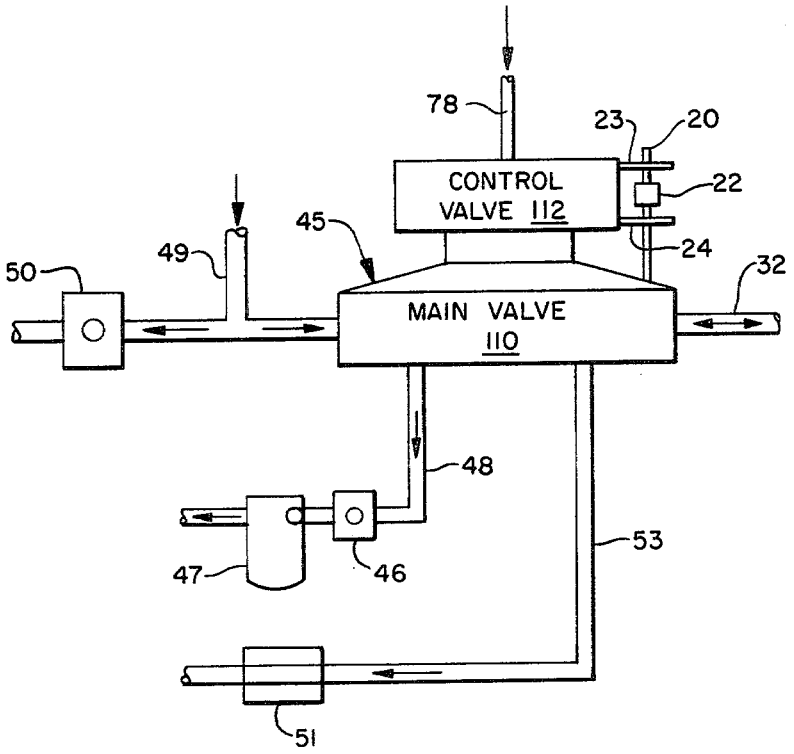
FIG. 11 is a schematic illustrating the flow of hydraulic fluid with reference to the valve 45.

FIG. 11 illustrates schematically the hydraulic circuit which controls the raising and lowering of the hydraulic piston rods 10 and the associated cross beam 8 with reference to the main valve 110 and the control valve 112 of the directional valve 45. During the raising of the piston rods 10 hydraulic fluid is pumped from pump 81, to the input of tee 49 where it divides into two streams. The first stream flows through one side of the output of tee 49, throttle valve 50 to sump 62 (FIG. 3). The degree of opening of the throttle valve 50 regulates the speed of the upward travel of the piston rods 10 by controlling the amount of fluid which flows from the pump 81 to the pistons 7 through the other side of the tee 49. The second output of tee 49 is connected to the directional valve 45. Hydraulic fluid flows from the second ouput of the tee 49, through the directional valve 45 and out through line 32 to hydraulic cylinders 7 to cause the piston rods 10 and associated cross beam 8 to rise. During the lowering of piston rods 10, hydraulic fluid flows from the pump 81, through both outputs of the tee 49 as described above during the raising of the piston rods 10, through the directional valve 45, line 53, which includes check valve 51, for maintaining the required pressure in the line to the sump 62. Also during the lowering of the piston rods 10, hydraulic fluid flows from the cylinders 7, through the main valve 45, through line 48 which includes throttle valve 46 for controlling the speed of lowering of the piston rods 10 and trap 47 to the sump 62. The control valve 112 is actuated by movement of the centering set collar 22 against either the top trip lever 23 to cause lowering of the piston rod 10 when the top of the stroke is reached or against the lower trip lever 24 to cause raising of the piston rod when the bottom of the stroke is reached. The control valve 112 is powered hydraulically via hydraulic line 78 which is coupled to pump 81. When the top lever 23 is moved by the centering set collar 22, the control valve 112 positions the main valve 110 to permit the hydraulic fluid flow described above with reference to lowering of the piston. When the bottom lever 24 is moved by the centering set collar 22, the control valve 112 positions the main valve 110 to permit the hydraulic fluid described above with reference to raising of the cylinders.

A splash plate, 54, is shown in the sump, 62, to aid in removing any entrapped air. A breather, 56, is shown to connect the hydraulic reservoir to atmosphere. During operation, considerable heat is generated in the hydraulic fluid. This is dissipated during the flow of the fluid through the four legs of reservoir-skid, 36. During cold weather operation the exhaust from engine, 70, may be run aperture, 61, extending across the back portion of skid, 36, to heat the fluid.

A modified version of the pump is shown in FIGS. 4–10. The principal change is in the actuator switch 96 which is coupled with a mechanically operated main valve, 97.

A stationary trip guide, 91, is anchored to the base plate. This guide extends upwardly and is surrounded by trip rod, 92, anchored at the top by carrier cross beam plate, 8. The rod has an upper set collar, 93, and lower set collar, 94, which cooperate with rod, 95, of actuator switch, 96.

Actuator switch, 96, is attached to switch bar, 98, which is attached to the stationary frame. A pair of circular plates, 99, are rotatably mounted by bolt, 100, and bearings, 101, onto bar, 98. The plates, 99, are also spaced apart by two stop support plates, 102, and by bolt, 103, and rod, 95.

Lower spring assemblies, 54, are attached to switch bar, 98. Upper spring assemblies, 56, are attached to each plate, 99. Springs 55 are attached to the two assemblies, rotatably biasing the switch in either the clockwise or counter-clockwise direction.

The rotation of the plates is restrained by rubber stops, 105, coming into contact with bar, 98, as the plates are rotated in one direction or the other.

Figure 9:
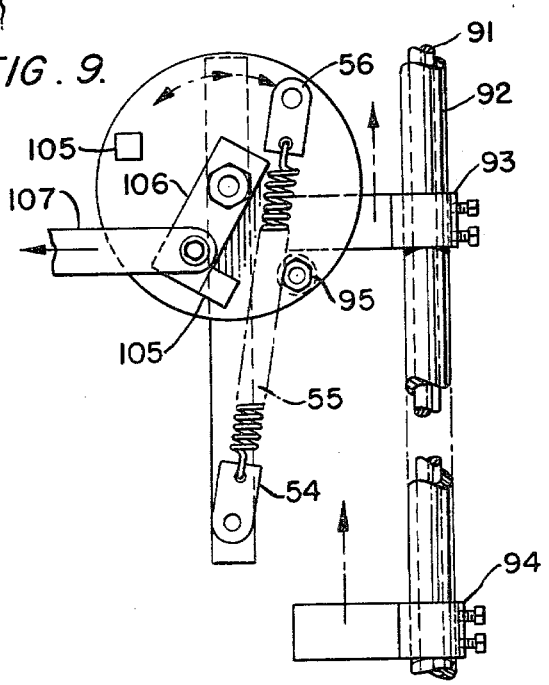
FIG. 9 is a view similar to FIG. 8 of the actuator switch in a first portion, and, FIG. 10 is a view similar to FIG. 9 of the actuator switch in the second position.
Figure 10:
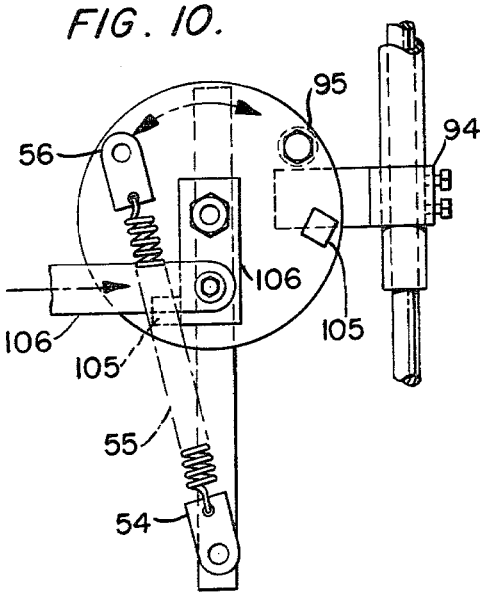
Figure 5:
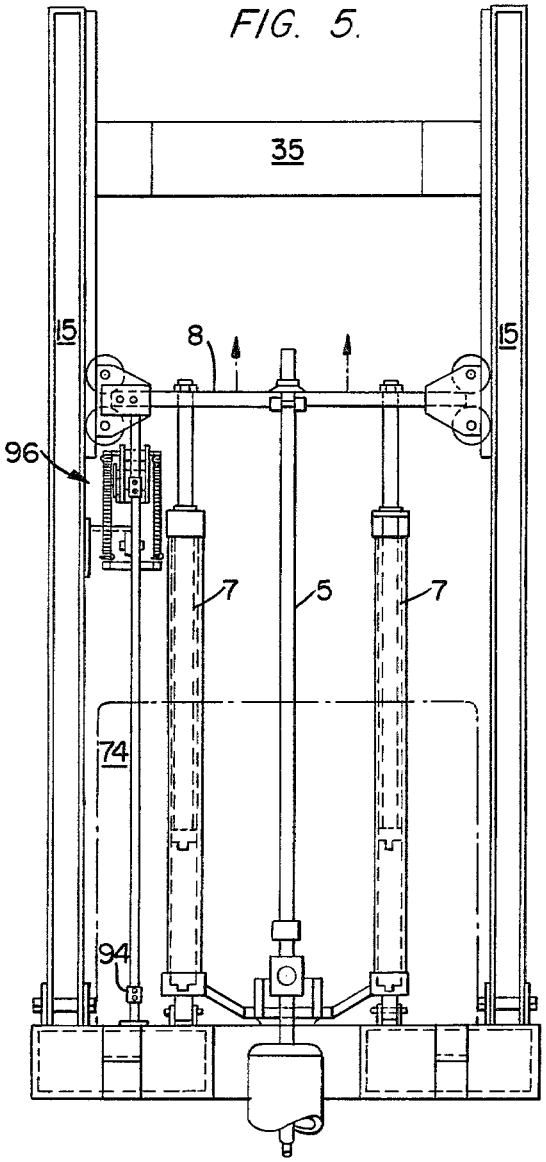
FIG. 5 is a front elevation view of the modified version of the invention.
Figure 6:
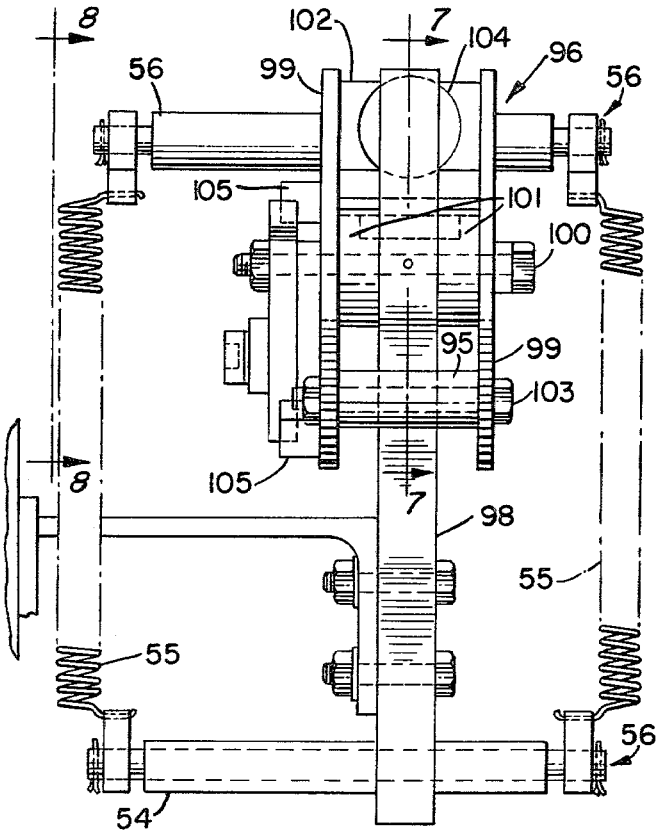
FIG. 6 is a detailed view of the actuator switch shown in FIG. 5.
Figure 7:
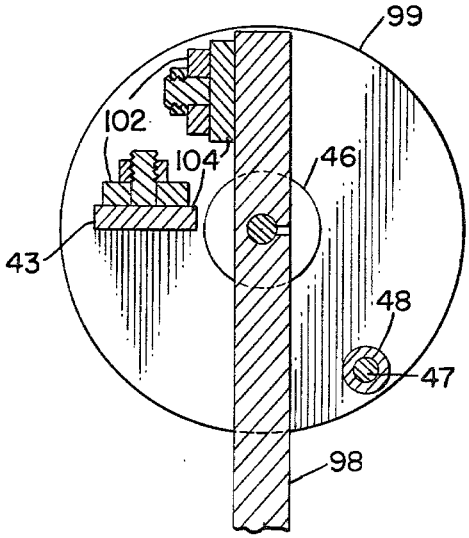
FIG. 7 is a sectional view taken on lines 7—7 of FIG. 6.
Figure 8:
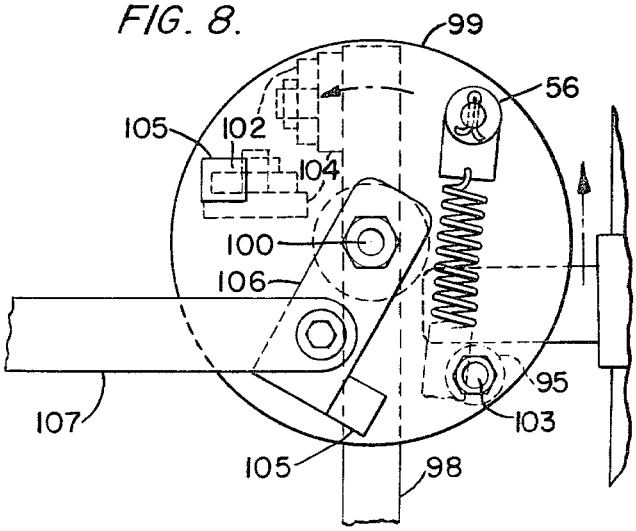
FIG. 8 is a side view, on lines 8—8 of FIG. 6.

As shown in FIGS. 9 and 10, upper collar, 93, contacts rod, 95, near the bottom of the stroke to rotate the plates clockwise until the stop, 104, shown in FIG. 8 prevents further rotation.

Near the top of the stroke, as shown in FIG. 10, lower set collar, 94, rotates the plates in a counter-clockwise direction until prevented by the other stop, 104, hitting the bar, 98.

On one plate, 99, are two stop bars, 105. Each cooperates with valve crank, 106, rotating it over a quarter of a circle. Crank 106, in turn reciprocates valve arm 107 to alter the action of main valve, 97.

Near the top of the stroke, the lower set collar, 94, rotates actuator switch, 96, causing valve arm, 106, to close the valves to the lower portion of the hydraulic cylinder and open the valves to the upper portion of the hydraulic cylinder driving the cylinder back down.

Corresponding changes are made to allow hydraulic fluid to leave the lower portion of the piston and discharge into the tank, 90.

At the bottom of the stroke, upper set collar, 93, initiates the opposite action, reconnecting the pump to the lower portion of the hydraulic cylinder.

Means may be provided to automatically reduce the rate of travel of the polish rod at the limits of its travel to reduce induced vibration in the sucker rod string.

Although the present invention has been described with reference to a particular embodiment thereof, it should be understood that those skilled in the art may make other modifications and embodiments thereof which will fall within the spirit and principles of this invention, and the scope of the appended claims.

What is claimed as new and desired to be secured by patent of the United States is:

1. A hydraulic pumping apparatus which is adapted for cyclically raising and lowering a polish rod and sucker rod string which extends down into a well which contains a fluid that is to be pumped from the well comprising:

(a) a base;

(b) a pair of vertically aligned hydraulic cylinders which are connected to said base, said cylinders each containing a piston and associated piston rod which moves when said hydraulic cylinder is coupled to a source of pressurized hydraulic fluid;

(c) a horizontal cross beam to which the piston rods of said cylinders are connected;

(d) means for connecting the polish rod to said cross beam so that the cross beam controls the vertical position of the polish rod;

(e) a pair of vertical supports aligned with said hydraulic cylinders, said vertical supports being spaced apart by a distance equal to the length of said cross beam;

(f) a pair of guide means at the ends of the cross beam to guide the cross beam along a selected length of said vertical supports;

(g) a reservoir for hydraulic fluid;

(h) a hydraulic pump having an input and an output the input being coupled to said reservoir;

(i) a first conduit having an input and first and second outputs, said input being coupled to the output of said hydraulic pump, the first output being coupled to a first valve which is coupled to the reservoir, said first valve being adjustable to regulate the amount of hydraulic fluid flowing between the input of said first conduit and the reservoir for controlling the upward speed of motion of the piston;

(j) valve means having an input coupled to the second output of the first conduit and an output coupled to said hydraulic cylinders, said valve means having first and second positions for selectively controlling the flow of hydraulic fluid through the second output of the first conduit and said output of the valve means, said first position of the valve means causing hydraulic fluid to flow from said hydraulic pump through the first output of the first conduit to said reservoir and from the hydraulic pump, through the second output of the first conduit, between the input of and the output of said valve means to the hydraulic cylinders to cause said piston to be moved vertically upward, said second position causing hydraulic fluid to flow from said hydraullic pump to said input of said valve means, through said valve means and a second conduit coupled between said valve means and said reservoir, and causing hydraulic fluid to flow from said hydraulic cylinders to the output of said valve means, through said valve means and a third conduit coupled between said valve means and said reservoir to cause said piston to move vertically downward, said valve means comprising a main valve which controls the flow of hydraulic fluid between the hydraulic pump, the reservoir and the hydraulic cylinders when the valve means is positioned in either the first or second positions;

(k) an adjustable valve disposed within said third conduit for regulating the flow rate of hydraulic fluid from the hydraulic cylinder to said reservoir for adjusting the downward speed of motion of the piston; and (l) an actuator for positioning of the valve means in either said first or second position, said actuator causing said valve means to be positioned in the second position when the polish rod moves vertically upward to the top of its stroke and causing said valve means to be positioned in the first position when the polish rod moves vertically downward to the bottom of its stroke, said actuator comprising:

(i) a vertically disposed trip rod secured to said base, (ii) an upper collar secured to said trip rod, (iii) a lower collar secured to said trip rod, (iv) a trip actuator plate coupled to said horizontal cross beam and slideably engaging said trip rod, (v) a top trip lever slideably engaging said trip rod, (vi) a bottom trip lever slideably engaging said trip rod, (vii) a centering collar secured to said trip rod which is disposed between said upper and lower trip levers, (viii) said trip actuator plate engaging said upper collar when said polish rod reaches the top of its stroke to cause said centering collar to engage said top trip lever to cause said main valve to be positioned in its second position, (ix) said trip actuator plate engaging said lower collar when said polish rod reaches the bottom of its stroke to cause said centering collar to engage said bottom trip lever to cause said main valve to be positioned in its first position, and the positioning of said main valve in its second position being caused by a control valve which is activated in response to said centering collar engaging said upper trip lever and the positioning of the main valve in said first position being caused by said control valve which is activated in response to said centering collar engaging said lower trip lever; and (m) a relief valve coupled between the output of the hydraulic pump and the input of the first conduit for regulating the maximum hydraulic fluid output pressure from said hydraulic pump, said relief valve being coupled to a fourth conduit which is coupled to said reservoir for causing hydraulic fluid to flow directly from said hydraulic pump to said reservoir when the maximum hydraulic fluid output pressure is reached.

2. A hydraulic pumping apparatus in accordance with claim 1 further comprising at least one hollow skid located within the base, said hollow skid functioning as said reservoir for hydraulic fluid.

* * * * *